US005358373A

United States Patent [19]

Hablanian

[11] Patent Number: 5,358,373

[45] Date of Patent: Oct. 25, 1994

[54] HIGH PERFORMANCE TURBOMOLECULAR VACUUM PUMPS

[75] Inventor: Marsbed Hablanian, Wellesley, Mass.

[73] Assignee: Varian Associates, Inc., Palo Alto, Calif.

[21] Appl. No.: 875,891

[22] Filed: Apr. 29, 1992

[51] Int. Cl.[5] ..... F01D 1/36

[52] U.S. Cl. ..... 415/90; 415/199.5; 415/194

[58] Field of Search ..... 415/90, 198.1, 199.4, 415/199.5, 209.1, 193, 194; 417/423.4

[56] References Cited

U.S. PATENT DOCUMENTS

| | | | |
|---|---|---|---|
| 1,288,360 | 12/1918 | Zaar | 415/193 |
| 2,785,849 | 3/1957 | Stalker | 415/194 |
| 3,138,318 | 6/1964 | Garnier et al. | 415/193 |
| 3,644,051 | 2/1972 | Shapiro . | |
| 4,904,155 | 2/1990 | Nagaoka et al. | 415/90 |
| 5,033,936 | 7/1991 | Shinojima | 415/90 |
| 5,074,747 | 12/1991 | Ikegami et al. . | |
| 5,158,426 | 10/1992 | Casaro et al. | 415/199.5 |

FOREIGN PATENT DOCUMENTS

| | | |
|---|---|---|
| 7237362 | 10/1972 | Fed. Rep. of Germany . |
| 3919529 | 1/1990 | Fed. Rep. of Germany . |
| 1313886 | 11/1961 | France . |

*Primary Examiner*—Edward K. Look

*Assistant Examiner*—Christopher Verdier

*Attorney, Agent, or Firm*—Bella Fishman; William R. McClellan

[57] ABSTRACT

Turbomolecular vacuum pumps having structures which provide increased pumping speed, increased discharge pressure and decreased operating power in comparison with prior art turbomolecular vacuum pumps. In a first embodiment, the stators of one or more axial flow vacuum pumping stages in proximity to the exhaust port of the vacuum pump have progressively lower conductance so that the bulk velocity of the gas being pumped is increased. In a second embodiment, one or more stages near the inlet port of the vacuum pump are provided with a peripheral channel to utilize the centrifugal component of the gas being pumped. In a third embodiment, one or more stages in the vacuum pump are molecular drag stages, each including a disk rotor. One or more pumping channels in the stator adjacent to the upper surface of the disk are connected in series with one or more pumping channels adjacent to the lower surface of the disk. In a fourth embodiment, one or more stages of the vacuum pump are regenerative stages, each including a regenerative impeller. Pumping channels in the upper and lower portions of the stator are connected in series. The stator channels can be provided with fixed, spaced-apart ribs for improved performance.

7 Claims, 12 Drawing Sheets

HIGH PERFORMANCE TURBOMOLECULAR VACUUM PUMPS

FIELD OF THE INVENTION

This invention relates to turbomolecular vacuum pumps and, more particularly, to turbomolecular vacuum pumps having structures which provide increased pumping speed, increased discharge pressure and decreased operating power in comparison with prior art turbomolecular vacuum pumps.

BACKGROUND OF THE INVENTION

Conventional turbomolecular vacuum pumps include a housing having an inlet port, an interior chamber containing a plurality of axial pumping stages and an exhaust port. The exhaust port is typically attached to a roughing vacuum pump. Each axial pumping stage includes a stator having inclined blades and a rotor having inclined blades. The rotor and stator blades are inclined in opposite directions. The rotor blades are rotated at high speed to provide pumping of gases between the inlet port and the exhaust port. A typical turbomolecular vacuum pump includes nine to twelve axial pumping stages.

Variations of the conventional turbomolecular vacuum pump are known in the prior art. In one prior art vacuum pump, a cylinder having helical grooves, which operates as a molecular drag stage, is added near the exhaust port. In another prior art configuration, one or more of the axial pumping stages are replaced with disks that rotate at high speed and function as molecular drag stages. A disk which has radial ribs at its outer periphery and which functions as a regenerative centrifugal impeller is disclosed in the prior art. Turbomolecular vacuum pumps utilizing molecular drag disks and regenerative impellets are disclosed in German Patent No. 3,919,529, published Jan. 18, 1990.

While prior art turbomolecular vacuum pumps have generally satisfactory performance under a variety of conditions, it is desirable to provide turbomolecular vacuum pumps having improved performance. In particular, it is desirable to increase the compression ratio so that such pumps can discharge to atmospheric pressure or to a pressure near atmospheric pressure. In addition, it is desirable to provide turbomolecular vacuum pumps having increased pumping speed and decreased operating power in comparison with prior art pumps.

It is a general object of the present invention to provide improved turbomolecular vacuum pumps.

It is another object of the present invention to provide turbomolecular vacuum pumps capable of discharging to relatively high pressure levels.

It is another object of the present invention to provide turbomolecular vacuum pumps having relatively high pumping speeds.

It is a further object of the present invention to provide turbomolecular vacuum pumps having relatively low operating power.

It is a further object of the present invention to provide turbomolecular vacuum pumps having high compression ratios for light gases.

It is still another object of the present invention to provide turbomolecular vacuum pumps which are easy to manufacture and which are relatively low in cost.

SUMMARY OF THE INVENTION

These and other objects and advantages are achieved in accordance with the present invention. According to a first aspect of the invention, a turbomolecular vacuum pump comprises a housing having an inlet port and an exhaust port, a plurality of axial flow vacuum pumping stages located within the housing and disposed between the inlet port and the exhaust port, each of the vacuum pumping stages including a rotor and a stator, and means for rotating the rotors such that gas is pumped from the inlet port to the exhaust port. Each rotor has inclined blades. One or more relatively high conductance stators are located in proximity to the inlet port. One or more relatively low conductance stators located in proximity to the exhaust port have lower conductance than the high conductance stators.

The low conductance stators preferably comprise a solid member having spaced-apart openings to permit gas flow. The openings can be defined by inclined blades. Alternatively, the low conductance stators can comprise a circular plate having spaced-apart openings near its periphery. In a preferred embodiment, a group of low conductance stators in proximity to the exhaust port has progressively lower conductance with decreasing distance from the exhaust port.

According to another aspect of the invention, a turbomolecular vacuum pump comprises a housing having an inlet port and an exhaust port, a plurality of axial flow vacuum pumping stages located within the housing and disposed between the inlet port and the exhaust port, each of the axial flow vacuum pumping stages including a rotor and a stator, each stator and each rotor having inclined blades, and means for rotating the rotors. The vacuum pump further includes means defining a peripheral channel surrounding at least a first stage of said vacuum pumping stages in proximity to the inlet port. The peripheral channel includes an annular space located radially outwardly of the inclined blades of the first stage rotor. The inclined blades of the first stage stator extend into the peripheral channel such that a centrifugal component of gas flow is directed through the peripheral channel toward the exhaust port.

Fixed, spaced-apart vanes can be located in the annular space radially outwardly of the inclined blades of the first stage rotor. The vanes can lie in radial planes or can be inclined with respect to radial planes. The vanes prevent backflow through the peripheral channel and assist in directing gas molecules toward the next stage in the vacuum pump.

According to a further aspect of the invention, a turbomolecular vacuum pump comprises a housing having an inlet port and an exhaust port, a plurality of vacuum pumping stages located within the housing and disposed between the inlet port and the exhaust port, each of the vacuum pumping stages including a rotor and a stator, and means for rotating the rotor such that gas is pumped from the inlet port to the exhaust port. One or more of the vacuum pumping stages comprises a molecular drag stage having a rotor comprising a molecular drag disk and a stator that defines a first channel in opposed relationship to an upper surface of the disk, a second channel in opposed relationship to a lower surface of the disk, and a conduit connecting the first and second channels. The stator of the molecular drag stage further includes a blockage in each of the first and second channels so that gas flows in series through the first channel and the second channel.

In a preferred embodiment, the first and second channels are spaced inwardly from an outer peripheral edge of the disk so that the outer peripheral edge of the disk extends into the stator, and leakage between the first and second channels is limited. In another embodiment, the first and second channels are annular with respect to the axis of rotation of the disk and the stator of the molecular drag stage further includes means defining a third annular channel in opposed relationship to the upper surface of the disk and means defining a fourth annular channel in opposed relationship to the lower surface of the disk. The third annular channel is connected in series with the first annular channel, and the fourth annular channel is connected in series with the second annular channel so that gas flows through the first, second, third and fourth annular channels in series.

According to yet another aspect of the present invention, one or more of the vacuum pumping stages of the turbomolecular vacuum pump comprise a regenerative stage including a rotor and a stator. The rotor comprises a disk. First spaced-apart rotor ribs are formed in an upper surface of the disk, and second spaced-apart rotor ribs are formed in a lower surface of the disk. The disk constitutes a regenerative impeller. The stator defines a first annular channel in opposed relationship to the first rotor ribs, a second annular channel in opposed relationship to the second rotor ribs and a conduit connecting the first and second annular channels. The stator of the regenerative stage further includes a blockage in each of the first and second annular channels so that gas flows in series through the first annular channel and the second annular channel.

In a preferred embodiment of the regenerative stage, the first and second channels are spaced inwardly from an outer peripheral edge of the disk so that the outer peripheral edge of the disk extends into the stator, and leakage between the first and second channels is limited.

According to a further embodiment of the invention, third spaced-apart rotor ribs formed in the upper surface of the disk, and fourth spaced-apart rotor ribs are formed in the lower surface of the disk. The stator includes third and fourth annular channels in opposed relationship to the third and fourth rotor ribs, respectively. The third annular channel is connected by a conduit to the first annular channel, and the fourth annular channel is connected by a conduit to the second annular channel. Gas flows through the first, second, third and fourth annular channels in series.

According to yet another feature of the invention, the stator channels of the regenerative stage are provided with spaced-apart stator ribs. The stator ribs can lie in radial planes or can be inclined.

According to another aspect of the invention, there is provided a method for improved vacuum pumping in a turbomolecular vacuum pump including a housing having an inlet port and an exhaust port, a plurality of vacuum pumping stages within the housing and disposed between the inlet port and the exhaust port, each of the vacuum pumping stages including a rotor and a stator, and means for rotating the rotors such that gas is pumped from the inlet port to the exhaust port. The method for improved vacuum pumping comprises the step of structuring one or more of the vacuum pumping stages that are located in proximity to the exhaust port for reduced pumping speed and increased compression ratio relative to the vacuum pumping stages located in proximity to the inlet port.

BRIEF DESCRIPTION OF THE DRAWINGS

For better understanding of the present invention, together with other and further objects, advantages and capabilities thereof, reference is made to the accompanying drawings which are incorporated herein by reference and in which.

DETAILED DESCRIPTION OF THE INVENTION

Figure 1:
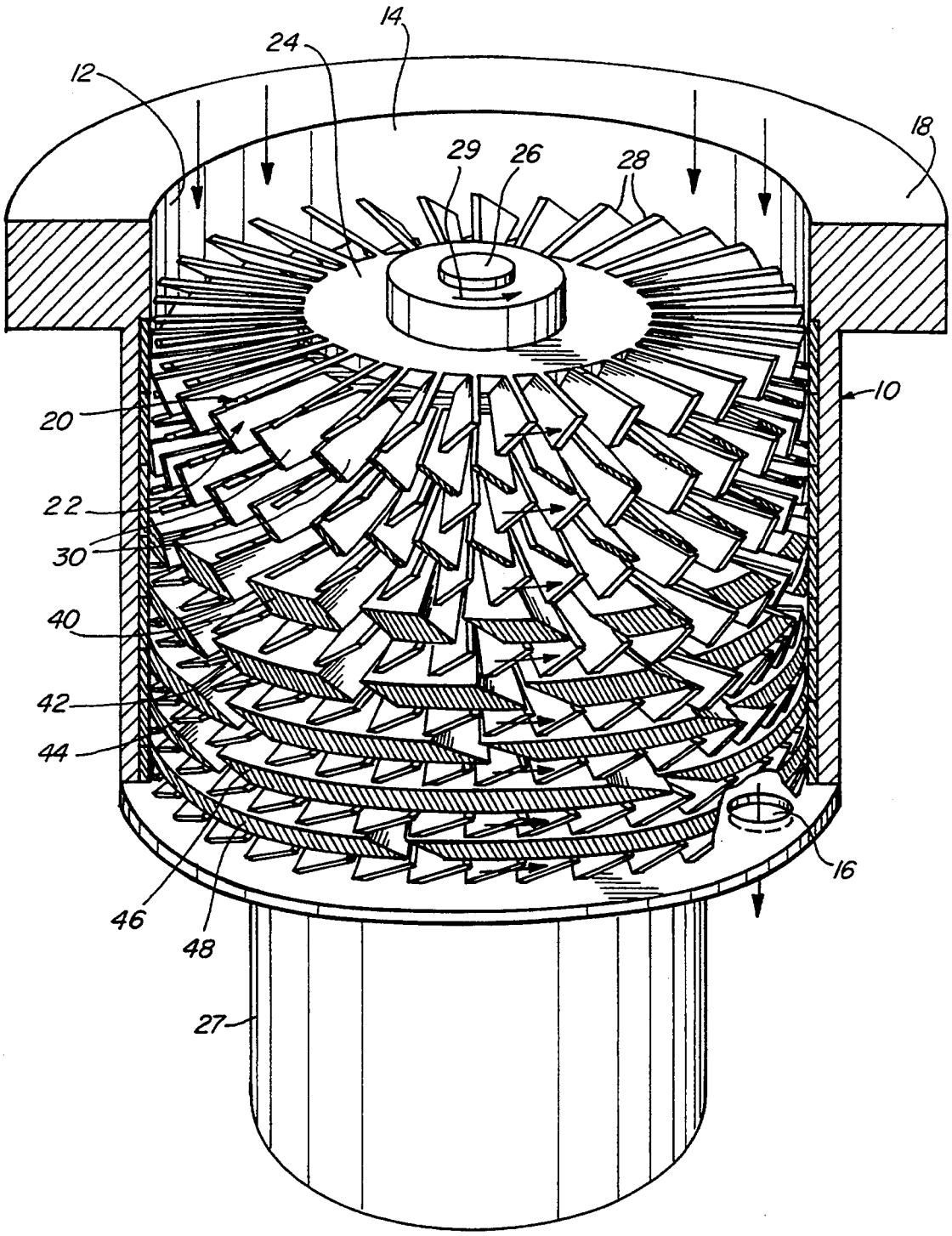
FIG. 1 is a partially broken away, perspective view of a turbomolecular vacuum pump in accordance with a first aspect of the present invention, wherein the stators have progressively lower conductance.

A turbomolecular vacuum pump in accordance with a first aspect of the present invention is shown in FIG. 1. A housing 10 defines an interior chamber 12 having an inlet port 14 and an exhaust port 16. The housing 10 includes a vacuum flange 18 for sealing of inlet port 14 to a vacuum chamber (not shown) to be evacuated. The exhaust port 16 is typically connected to a backing vacuum pump (not shown). In cases where the turbomolecular vacuum pump is capable of exhausting to atmospheric pressure, a backing pump is not required. Located within chamber 12 is a plurality of axial flow vacuum pumping stages. Each of the vacuum pumping stages includes a rotor 20 and a stator 22. The embodiment of FIG. 1 includes eight stages. It will be understood that a different number of stages can be utilized depending on the vacuum pumping requirements. Typically, turbomolecular vacuum pumps have about nine to twelve stages.

Each rotor 20 includes a central hub 24 attached to a shaft 26. Inclined blades 28 extend outwardly from the hub 24 around its periphery. Typically, all of the rotors have the same number of inclined blades, although the angle and width of the inclined blades may vary from stage to stage.

The shaft 26 is rotated at high speed by a motor located in a housing 27 in a direction indicated by arrow 29 in FIG. 1. The gas molecules are directed generally axially by each vacuum pumping stage from the inlet port 14 to the exhaust port 16.

Figure 3:
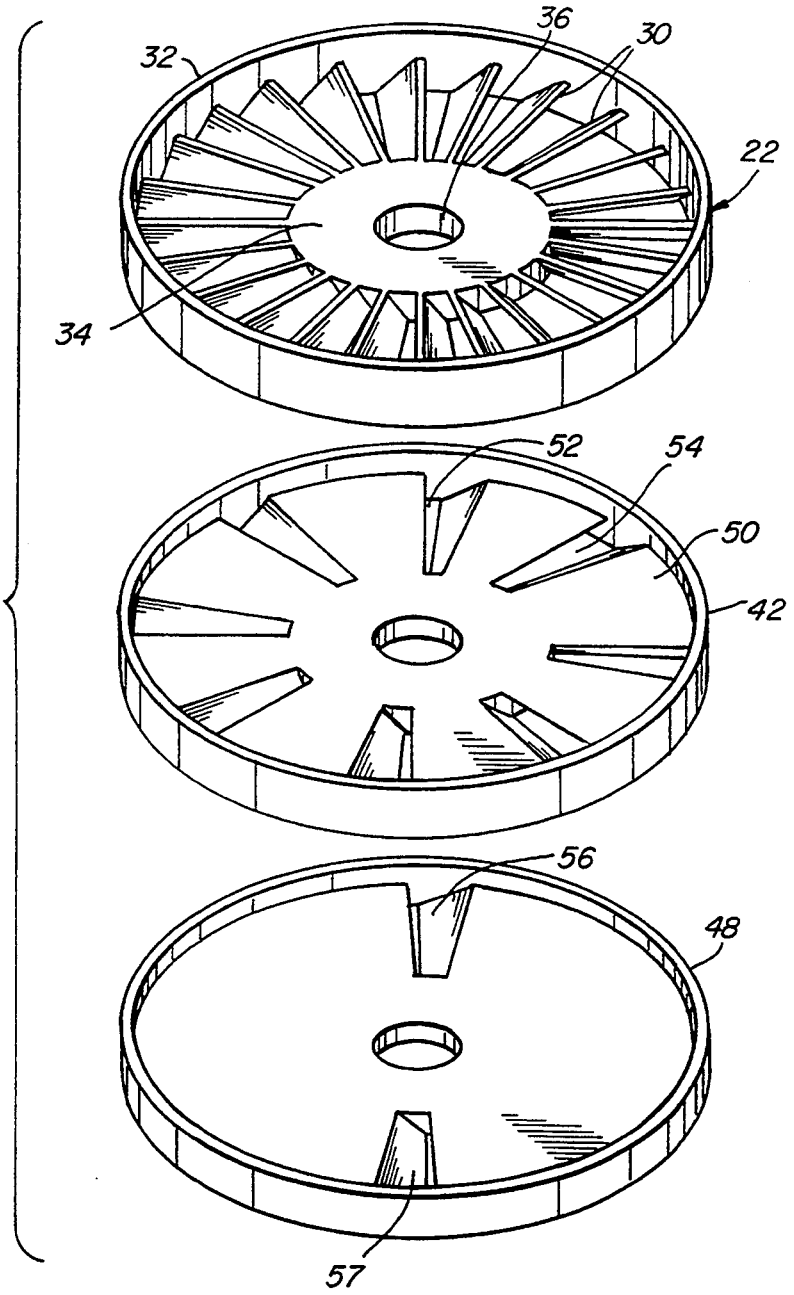
FIG. 3 is an exploded perspective view of the stators for three stages of the vacuum pump of FIG. 1.

The stators have different structures in different stages. Specifically, one or more stators in proximity to inlet port 14 have a conventional structure with relatively high conductance. In the embodiment of FIG. 1, two stages in proximity to inlet port 14 have stators with relatively high conductance. The high conductance stators 22, as best shown in FIG. 3, include inclined blades 30 which extend inwardly from a circular spacer 32 to a hub 34. The hub 34 has an opening 36 for a shaft 26 but does not contact shaft 26. In the first two stages of the vacuum pump in proximity to inlet port 14, the stators 22 usually have the same number of inclined blades as the rotor 20. The blades of the rotor and the blades of the stator are inclined in opposite directions.

Starting with the third stage from inlet port 14 and progressing toward exhaust port 16, stators 40, 42, 44, 46 and 48 have progressively lower conductance than the high conductance stators 22. Thus, the stators progress from medium conductance in the middle of the pump to low conductance near exhaust port 16. The stators 40, 42, 44, 46 and 48 can have any convenient structure which provides the desired conductance. In the embodiment shown in FIG. 1, each medium and low conductance stator is fabricated as a circular plate having openings. The structure of stators 42 and 48 is shown in FIG. 3. In stator 42, a circular stator plate 50 is provided with inclined openings 52, 54, etc., which simulate the openings between inclined blades. The stator 42 has eight openings, and stator 48 has only two openings 56 and 57. In the embodiment illustrated, the conductance of stators 40, 42, 44, 46 and &8 is progressively reduced toward exhaust port 16 by progressively reducing the number of openings in the stator plates.

It will be understood that other structures can be utilized for providing reduced conductance stators. For example, the inclined openings 54 in stator plate 50 can be replaced with holes that are drilled near the outer periphery of stator plate 50. The number and/or size of the openings in stator plate 50 can be varied to provide the required conductance. Furthermore, two or more medium or low conductance stators can have the same conductance to simplify the fabrication of the pump. The stators 22, 42 and 48 illustrated in FIG. 3 are typically machined from a solid disk.

Figure 4:
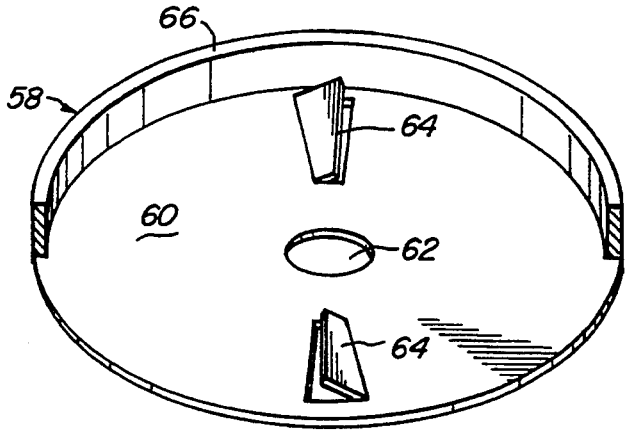
FIG. 4 is a perspective view of an alternative embodiment of a low conductance stator.

An alternate stator construction is illustrated in FIG. 4. A stator 58 includes a thin metal plate 60 wherein a central opening 62 and louvers 64 are formed by stamping. A circular spacer 66 is attached to the outer periphery of plate 60.

Figure 2:
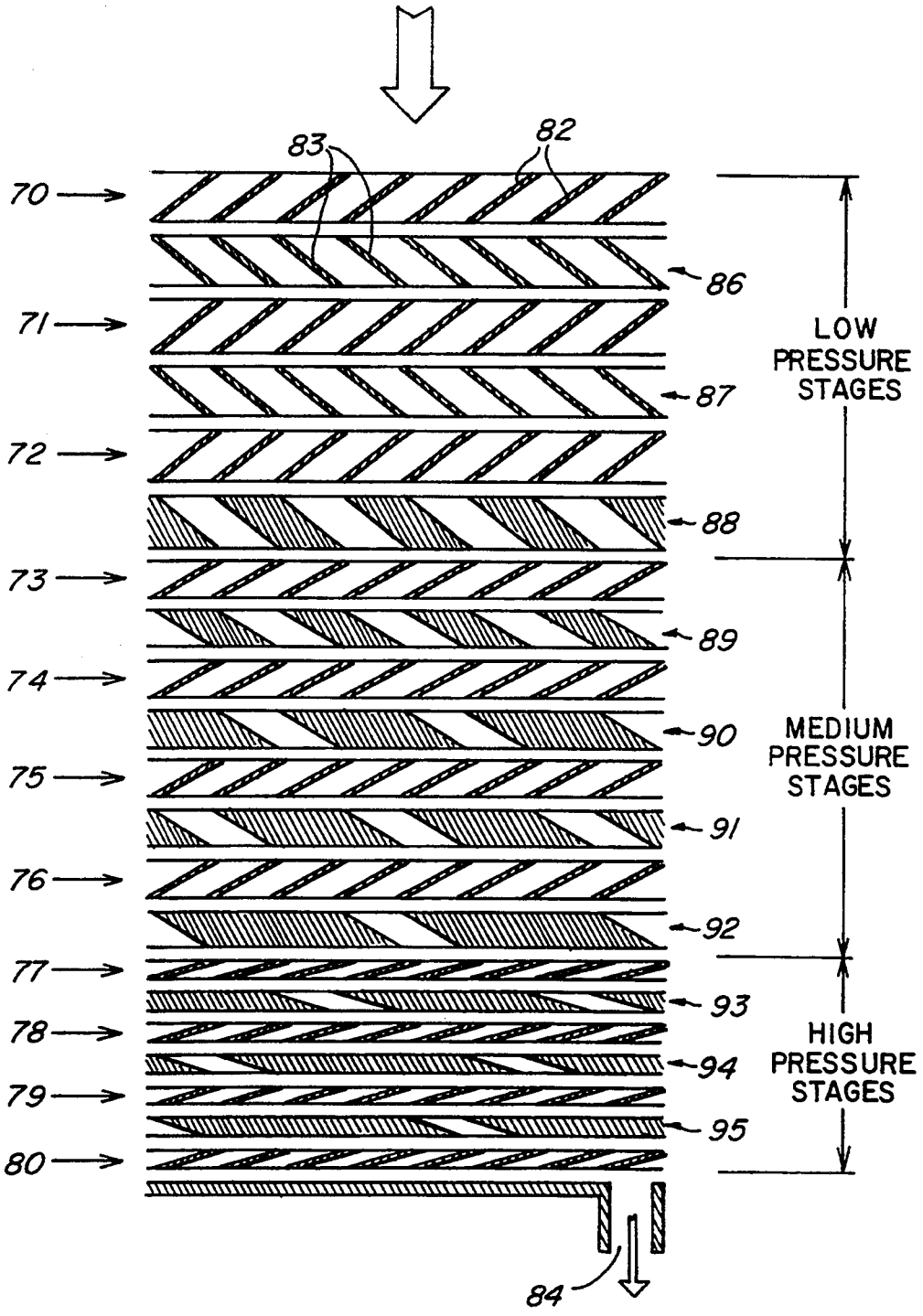
FIG. 2 is a schematic cross-sectional representation of a turbomolecular vacuum pump similar to the pump of FIG. 1 but with more stages.

A schematic representation of a turbomolecular vacuum pump similar to the pump of FIG. 1 but with more stages is shown in FIG. 2. Rotors 70–80 all include as usual the same number of inclined blades 82. Stators 86 and 87 in the first two stages near the inlet port have conventional inclined blades 83. Stators 88–95 have progressively lower conductance with decreasing distance from exhaust port 84. It will be understood that the number of stators having reduced conductance can be varied. Preferably, stators between about the midpoint of the vacuum pump and the exhaust port have lower conductance than the stators near the inlet port.

The configuration of the stators shown in FIGS. 1–4 is based on the fact that the bulk velocity of the gas being pumped is reduced at the exhaust port 16 in proportion to the compression ratio of the pump. The flow in the last two or three stages of a conventional prior art turbomolecular vacuum pump is essentially stagnant. Under such conditions, the power of the motor is wasted in sloshing the stagnant gas in and out of the stators. By providing progressively lower conductance stators in proximity to the exhaust port 16, the bulk velocity is maintained, the pressure ratio is increased and the motor power is reduced. Another reason for increasing the bulk velocity in the higher pressure stages of the vacuum pump is that the back diffusion of light gases, such as hydrogen and helium, is decreased.

In conventional turbomolecular vacuum pumps, hydrogen has an easy path for back diffusion across the entire cross-sectional area of the bladed stages. However, in the turbomolecular vacuum pump shown in FIG. 1, back diffusion must occur against the stream of pumped gas (usually water vapor and air) which has a substantial forward velocity toward the exhaust port 16. Furthermore, back diffusion must occur through the small holes in each stator which may have 100 times lower cross-sectional area than prior art stators.

Figure 5:
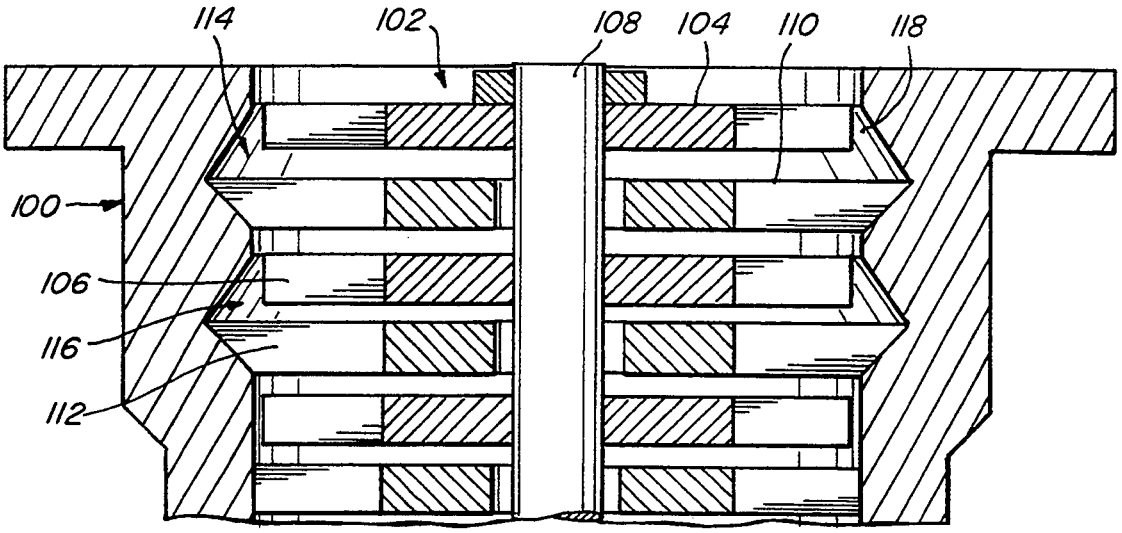
FIG. 5 is a partial cross-sectional view of a turbomolecular vacuum pump wherein the stators of the first two stages are modified in accordance with a second aspect of the invention.
Figure 6:
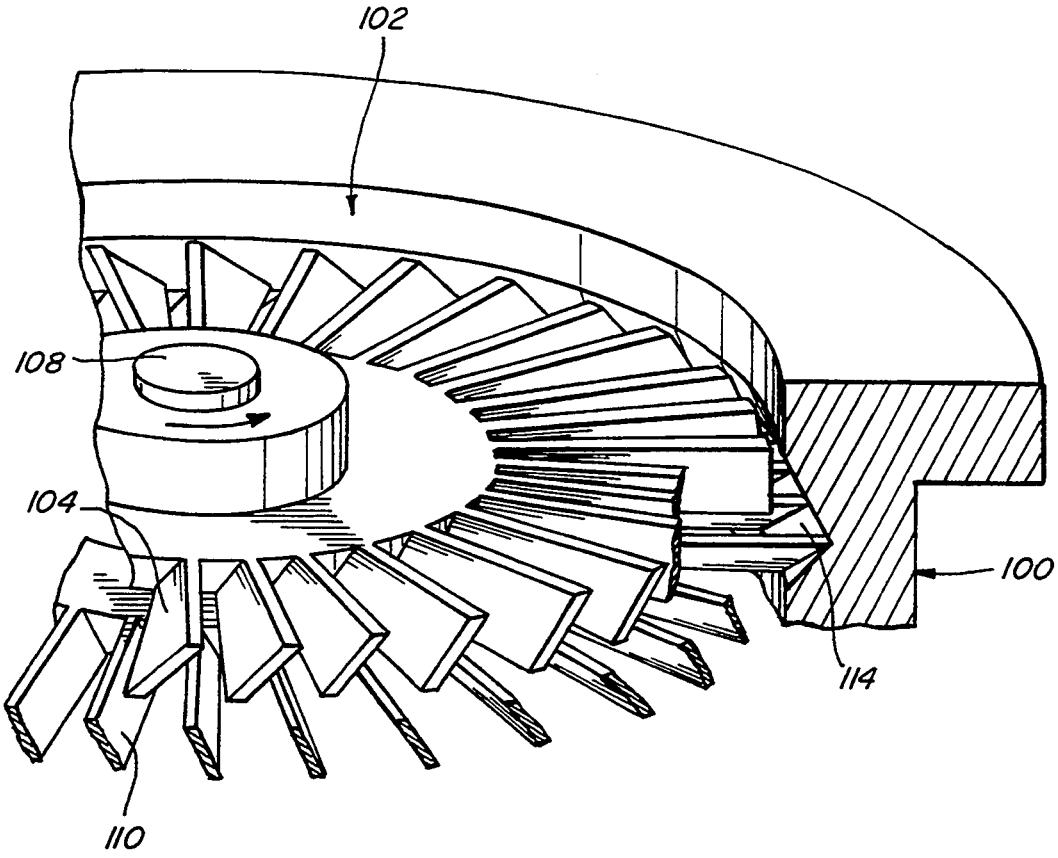
FIG. 6 is a fragmentary perspective view of the first stage rotor and stator of FIG. 5.

A second aspect of the invention is shown in FIGS. 5 and 6. The first few stages of a turbomolecular vacuum pump in proximity to the inlet port are illustrated. A pump housing 100 has an inlet port 102. A first pumping stage includes a rotor 104 and a stator 110. A second pumping stage includes a rotor 106 and a stator 112. The first stage rotor 104 and the second stage rotor 106 are attached to a shaft 108 for high speed rotation about a central axis. The first stage stator 110 and the second stage stator 112 are mounted in fixed positions relative to housing 100. The rotors 104 and 106 and the stators 110 and 112 each have multiple inclined blades. As discussed above, in connection with FIG. 1, the blades of rotors 104 and 106 are inclined in an opposite direction from the blades of stators 110 and 112.

In the embodiment of FIGS. 5 and 6, a peripheral channel 114 surrounds the first stage and a peripheral channel 116 surrounds the second stage. The peripheral channels 114 and 116 have the same configuration and function in the same manner. Thus, only channel 114 will be described. The peripheral channel 114 includes an annular space 118 located radially outwardly of first stage rotor 104. The blades of first stage stator 110 extend into and contact the wall of peripheral channel 114. In the embodiment of FIGS. 5 and 6, the peripheral channel 114 has a triangular cross-section in a radial plane. Depending on the structure of the pump, the peripheral channels 114 and 116 can be considered as defined by the stator structure or as defined by the housing. Relatively small clearances are provided between housing 100 and rotor 104 and between housing 100 and rotor 106 at the upper and lower edges, respectively, of peripheral channel 114. This configuration prevents reverse flow of gas through channel 114 toward the inlet port 102.

As indicated above, the gas flow through a turbomolecular vacuum pump utilizing axial pumping stages is generally parallel to the axis of rotation. However, the gas flow has a centrifugal velocity component. The vacuum pump shown in FIGS. 5 and 6 and described above utilizes the centrifugal velocity component to increase pumping speed. Gas molecules entering the peripheral channels 114 and 116 as a result of centrifugal movement are directed to the next stage. Gas molecules near the tips of the inclined blades of rotor 104 have a centrifugal component and move radially outwardly into peripheral channel 114. The molecules are then directed downwardly through stator 110 by the angled inside surface of peripheral channel 114.

Figure 7:
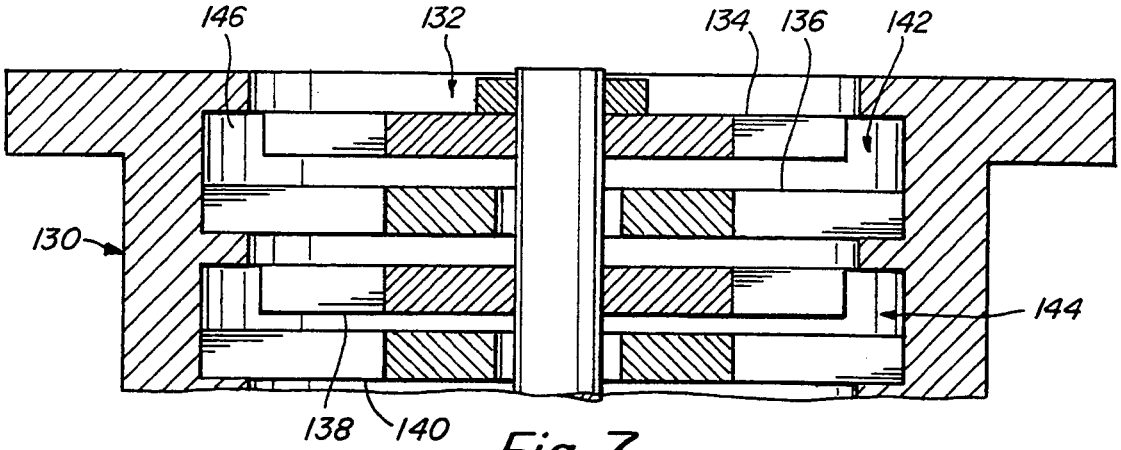
FIG. 7 is a partial cross-sectional view of another embodiment of a turbomolecular vacuum pump wherein the stators of the first two stages are modified.
Figure 8:
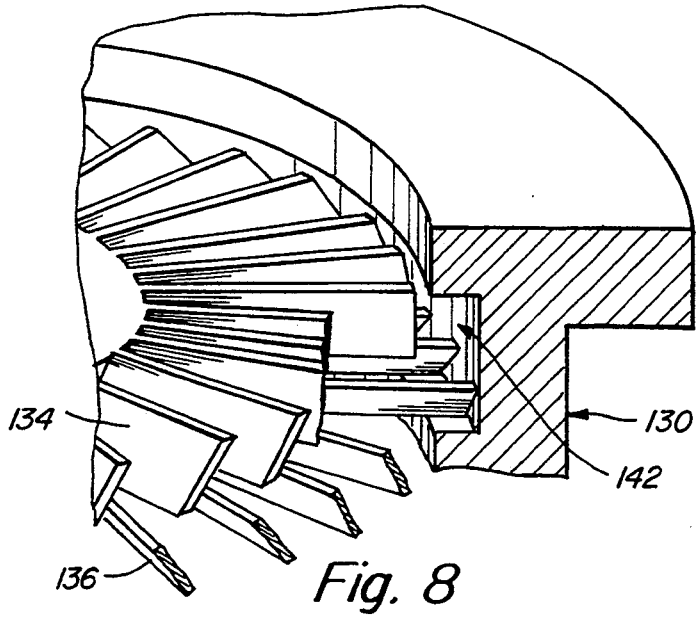
FIG. 8 is a fragmentary perspective view of the first stage rotor and stator of FIG. 7.

An alternate embodiment of a turbomolecular vacuum pump which utilizes the centrifugal component of gas velocity is shown in FIGS. 7 and 8. A pump housing 130 has an inlet port 132. A first pumping stage includes a rotor 134 and a stator 136. A second pumping stage includes a rotor 138 and a stator 140. A peripheral channel 142 surrounds the first stage, and a peripheral channel 144 surrounds the second stage. The peripheral channel 142 includes an annular space 146 radially outwardly of rotor 134. The inclined blades of stator 136 extend into and contact the wall of peripheral channel 142. In the embodiment of FIGS. 7 and 8, the peripheral channel 142 has a rectangular cross-section in a radial plane. The peripheral channels 142 and 144 operate generally in the same manner as peripheral channels 114, 116 described above.

It will be understood that the number of stages having peripheral channels to utilize the centrifugal component of gas velocity is optional. Typically, one or two stages in proximity to the inlet port of the vacuum pump are provided with peripheral channels as described above.

Figure 9:
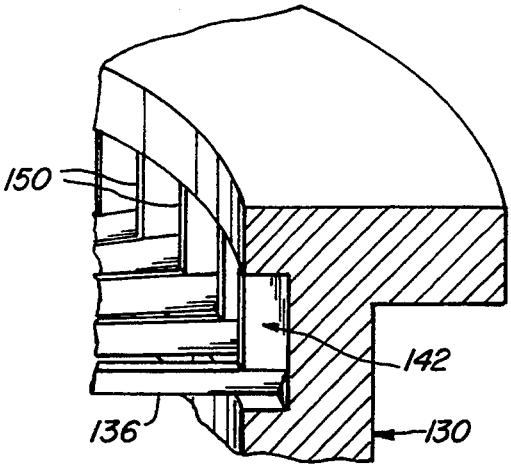
FIG. 9 is a fragmentary perspective view of another embodiment of the pump shown in FIG. 7 wherein radial vanes are provided in the annular space around the first stage rotor.

Another embodiment of the pump configuration of FIGS. 7 and 8 which utilizes the centrifugal component of gas velocity is shown in FIG. 9. The peripheral channel 142 is provided with fixed, spaced-apart vanes 150 in the annular space 146 around rotor 134. In the embodiment of FIG. 9, the vanes 150 lie in radial planes that pass through the axis of rotation of the rotors. The vanes 150 extend from the upper edges of the inclined blades of stator 136.

Figure 10:
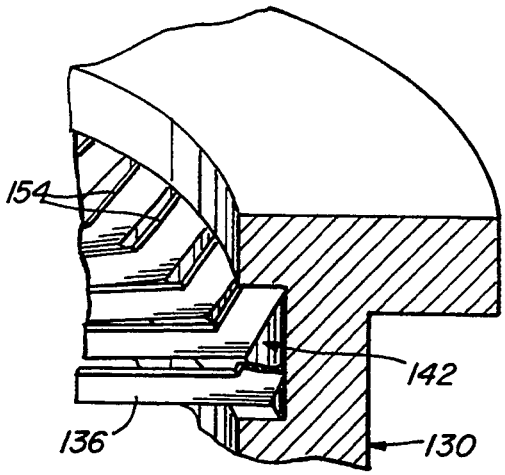
FIG. 10 is a fragmentary perspective view in accordance with a further embodiment of the pump shown in FIG. 7 wherein inclined vanes are provided in the annular space around the first stage rotor.

Yet another embodiment of the pump configuration of FIGS. 7 and 8 which utilizes the centrifugal component of gas velocity is shown in FIG. 10. Fixed, spaced-apart vanes 154 are positioned in the annular space 146 around rotor 134. In the embodiment of FIG. 10, the vanes 154 are inclined with respect to radial planes that pass through the axis of rotation. Inclined vanes 154 extend from the upper edges of the blades of stator 136.

The fixed vanes 150 and 154 in the peripheral channel 142 tend to direct gas molecules having a centrifugal velocity component downwardly through the stator to the next stage and prevent backflow of gas molecules through the peripheral channel 142. In general, the peripheral channel around one or more stages near the inlet port of the pump can have any convenient cross-sectional shape that tends to direct gas molecules toward the next stage. The housing or stator should be configured at the upper and lower edges of the peripheral channel to nearly contact the respective rotors and thereby prevent backflow of gas toward the inlet port.

Figure 11:
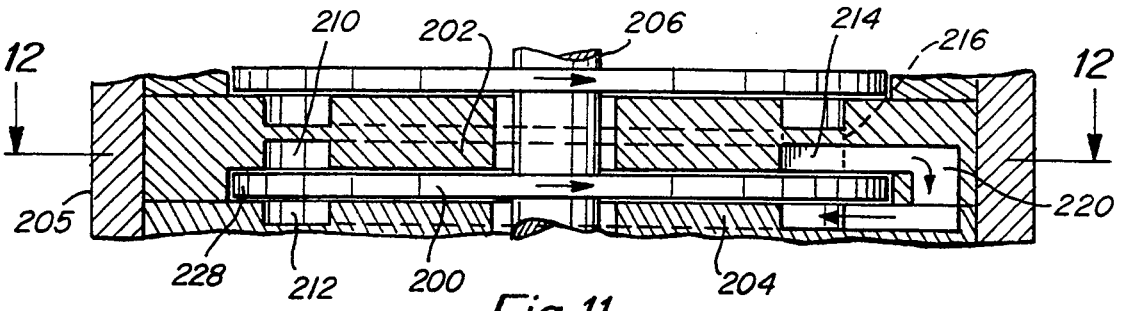
FIG. 11 is a partial cross-sectional view of a turbomolecular vacuum pump in accordance with a third aspect of the invention utilizing one or more molecular drag vacuum pumping stages.
Figure 12:
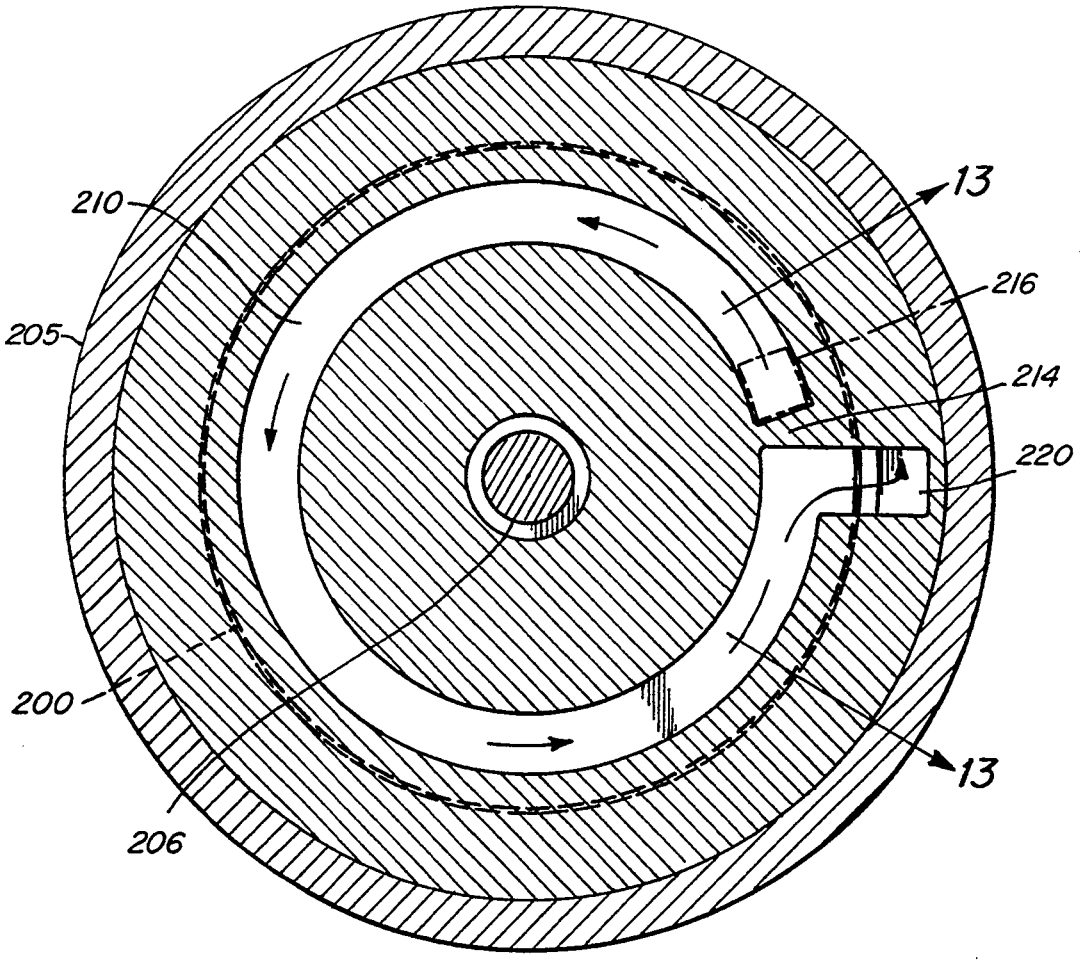
FIG. 12 is a cross-sectional plan view of the molecular drag stage taken along the line 12—12 of FIG. 11.
Figure 13:
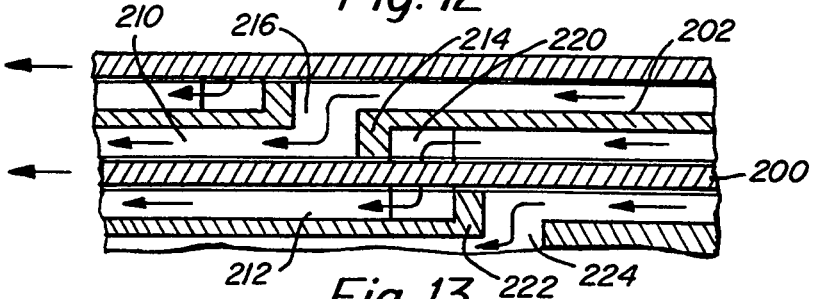
FIG. 13 is a partial cross-sectional view of the molecular drag stage taken along the line 13—13 of FIG. 12.

A third aspect of the invention is illustrated in FIGS. 11–13. One or more axial flow vacuum pumping stages of a conventional turbomolecular vacuum pump are replaced with molecular drag stages. In the molecular drag stage, the rotor comprises a disk and the stator is provided with channels in closely spaced opposed relationship to the disk. When the disk is rotated at high speed, gas is caused to flow through the stator channels by the molecular drag produced by the rotating disk.

Referring to FIGS. 11–13, a molecular drag stage in accordance with the invention includes a disk 200, an upper stator portion 202 and a lower stator portion 204 mounted within a housing 205. The upper stator portion 202 is located in proximity to an upper surface of disk 200, and lower stator portion 204 is located in proximity to a lower surface of disk 200. The upper and lower stator portions 202 and 204 together constitute the stator for the molecular drag stage. The disk 200 is attached to a shaft 206.

The upper stator portion 202 has an upper channel 210 formed in it. The channel 210 is located in opposed relationship to the upper surface of disk 200. The lower stator portion 204 has a lower channel 212 formed in it. The channel 212 is located in opposed relationship to the lower surface of disk 200. In the embodiment of FIGS. 11–13, the channels 210 and 212 are circular and are concentric with the disk 200. The upper stator portion 202 includes a blockage 214 of channel 210 at one circumferential location. The channel 210 receives gas from the previous stage through a conduit 216 on one side of blockage 214. The gas is pumped through channel 210 by molecular drag produced by the rotating disk 200. At the other side of blockage 214, a conduit 220 formed in stator portions 202 and 204 interconnects channels 210 and 212 around the outer peripheral edge of disk 200. The lower stator portion 204 includes a blockage 222 of lower channel 212 at one circumferential region. The lower channel 212 receives gas on one side of blockage 222 through conduit 220 from the upper surface of disk 200 and discharges gas through a conduit 224 on the other side of blockage 222 to the next stage.

The operation of the molecular drag stage of FIGS. 11–13 will now be described. Gas is received from the previous stage through conduit 216. The previous stage can be a molecular drag stage, an axial flow stage, or any other suitable vacuum pumping stage. The gas is pumped around the circumference of upper channel 210 by molecular drag produced by rotation of disk 200. The gas then passes through conduit 220 around the outer periphery of disk 200 to lower channel 212. The gas then is pumped around the circumference of lower channel 212 by molecular drag and is exhausted through conduit 224 to the next stage or to the exhaust port of the pump. Thus, upper channel 210 and lower channel 212 are connected such that gas flows through them in series. As a result, the molecular drag stage of the present invention provides a higher compression ratio than prior art stages which operate in parallel.

According to a further feature of the molecular drag stage, the upper channel 210 and the lower channel 212 are preferably spaced inwardly from the outer peripheral edge of disk 200. With this configuration, an outer peripheral portion 228 of disk 200 extends into stator portions 202 and 204, thereby limiting leakage between channels 210 and 212 around the outer edge of disk 200, except through conduit 220. It will be understood that the radial position of channels 210 and 212 is a tradeoff between two opposing factors. It is desired to position the channels 210 and 212 as close as possible to the outer periphery of disk 200 for high rotational velocity and, consequently, higher pumping speed. Conversely, it is desirable to position channels 210 and 212 inwardly from the outer edge of disk 200 to reduce leakage between channels 210 and 212. It will be understood that the channels 210 and 212 can be positioned at the outer periphery of disk 200 within the scope of the invention. However, in this case the allowable spacing between rotor and stator must be reduced to limit leakage, thereby reducing tolerances and increasing cost.

Channels 210 and 212 are shown in FIGS. 11–13 as having rectangular cross sections. It will be understood that any practical cross-sectional shape can be utilized within the scope of the present invention. Furthermore, channels 210 and 212 are not necessarily equal in shape or size. The primary requirement is that the upper and lower channels 210 and 212 be connected in series for high compression ratio and that leakage between the channels be limited.

Figure 14:
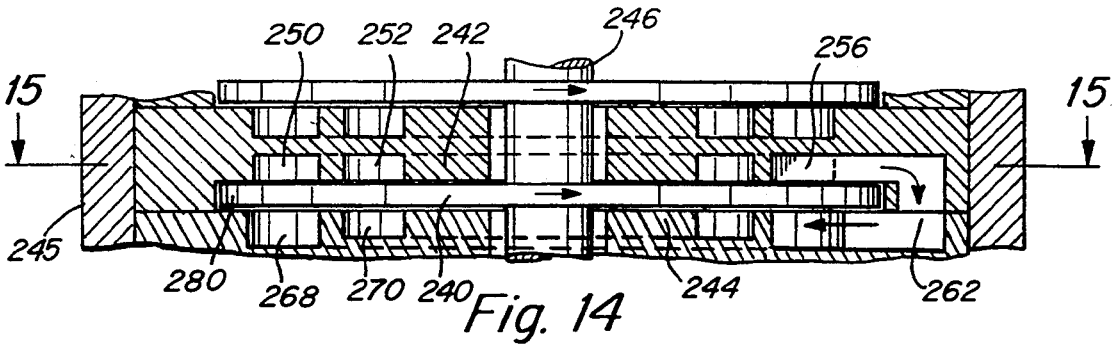
FIG. 14 is a partial cross-sectional view of another embodiment of a turbomolecular vacuum pump utilizing one or more molecular drag stages.
Figure 15:
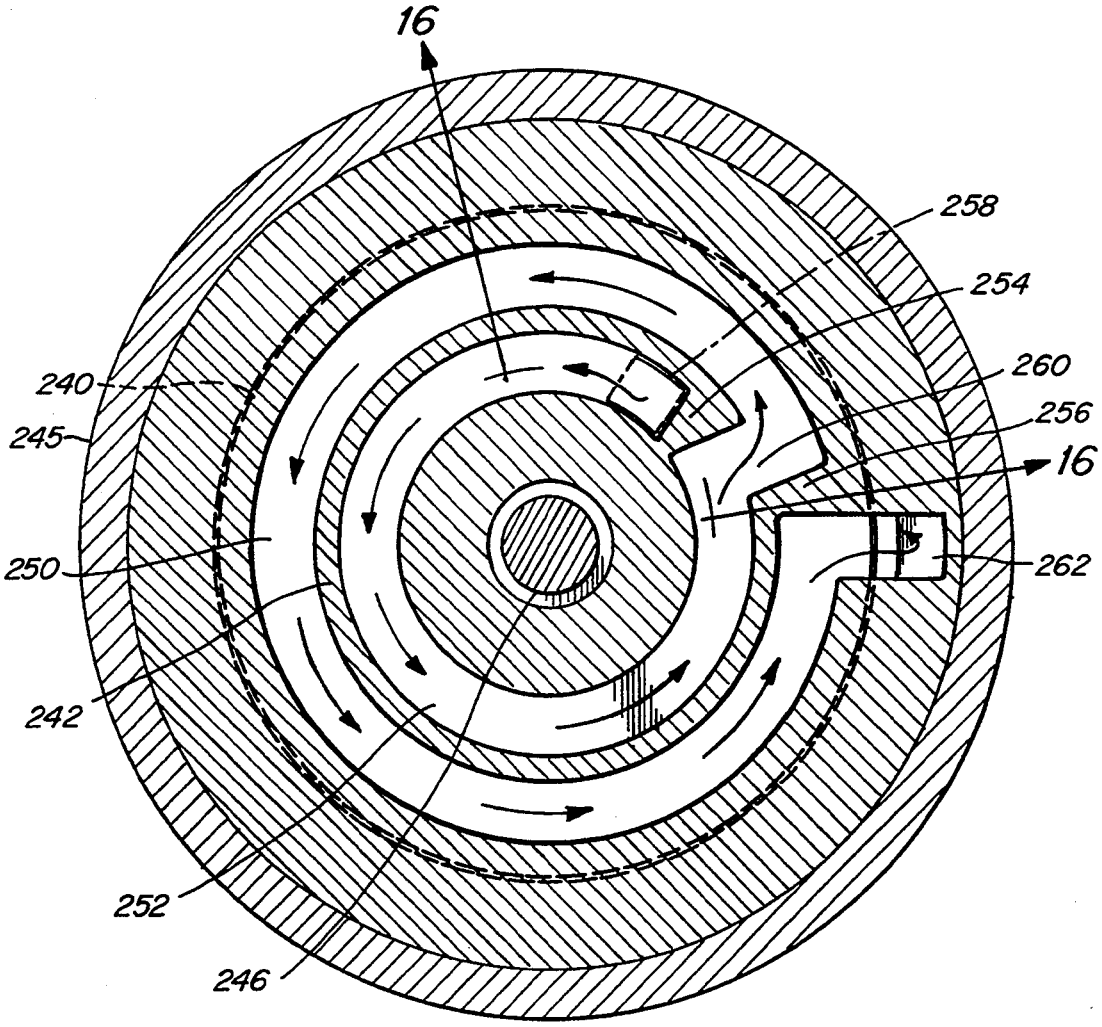
FIG. 15 is a cross-sectional plan view of the molecular drag stage of FIG. 15 taken along the line 15—15 of FIG. 14.
Figure 16:
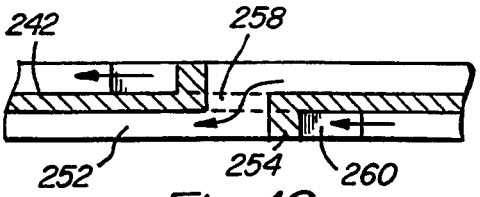
FIG. 16 is a partial cross-sectional view of the upper portion of the stator taken along the line 16—16 of FIG. 15.

An alternate embodiment of the molecular drag stage in accordance with the invention is shown in FIGS. 14–16. The molecular drag stage includes a disk 240, an upper stator portion 242, and a lower stator portion 244 mounted within a housing 245. The disk 240 is attached to a shaft 246 for rotation about a central axis. In the embodiment of FIGS. 14–16, the upper stator portion 242 defines an outer channel 250 and an inner channel 252, which are preferably circular and concentric. The upper stator portion 242 includes a blockage 254 in inner channel 252, and a blockage 256 in outer channel 250. Gas enters inner channel 252 from the previous stage through a conduit 258 located on one side of blockage 254. On the other side of blockage 254, a conduit 260 connects inner channel 252 to outer channel 250. The conduit 260 is located adjacent to blockage 256 in outer channel 250. On the other side of blockage 256, a conduit 262 connects channel 250 in upper stator portion 242 to an outer channel in the lower stator portion 244. Lower stator portion 244 includes an outer channel 268 and an inner channel 270, which are preferably circular and concentric. The channels 268 and 270 have the same configuration as channels 250 and 252.

In operation, gas enters the molecular drag stage from the previous stage through conduit 258. The previous stage can be another molecular drag stage, an axial flow stage, or any other suitable vacuum pumping stage. The gas is pumped through channel 252 by molecular drag produced by the rotation of disk 240 and then passes through conduit 260 to outer channel 250. The gas is similarly pumped through outer channel 250 by molecular drag to conduit 262. The gas then passes through conduit 262 around the outer edge of disk 240 to outer channel 268 in lower stator portion 244. The gas is pumped through outer channel 268 and then through inner channel 270 by molecular drag and is discharged to the next stage, or to the exhaust port of the vacuum pump.

The molecular drag stage of FIGS. 14–16 functions by serially pumping gas through channels 252, 250, 268 and 270 with a single rotating disk 240. The molecular drag stage of FIGS. 14–16 thus provides a high compression ratio.

As discussed above in connection with FIGS. 11–13, the channels 250 and 270 are preferably spaced inwardly from the outer peripheral edge of disk 240. An outer peripheral edge 280 of disk 240 extends into stator portions 242 and 244. As a result, the leakage path between channels 250 and 270 is relatively long and leakage is limited. The radial position of channels 250 and 270 is a tradeoff between reducing leakage between the upper and lower surfaces of disk 240 and maintaining high rotational velocity of disk 240 adjacent to channels 250 and 270. Similarly, selection of the spacing between channels 250 and 252 and the spacing between channels 268 and 270 is a tradeoff between limiting leakage between adjacent channels and maintaining a high rotational velocity of disk 240 adjacent to the inner channels.

As in the embodiment of FIGS. 11–13, the stator channels 250, 252, 268 and 270 can have any convenient cross-sectional size and shape. The inner and outer channels are not necessarily the same size and shape. Three or more stator channels can be utilized adjacent to each surface of the disk if desired. In general, any practical number of stator channels can be used adjacent to each surface of the disk. The gas can be pumped through the channels in the opposite direction from that shown. The channels are not necessarily concentric as shown in FIGS. 14–16. According to a further embodiment, the stator channels adjacent the upper and lower surfaces of the disk can be spiral rather than circular. The main requirement of the embodiment shown in FIGS. 14–16 is to provide a relatively long pumping path on the upper surface of disk 240 and a relatively long pumping path on the lower surface of disk 240, with the pumping paths being connected in series for a high compression ratio.

Figure 17:
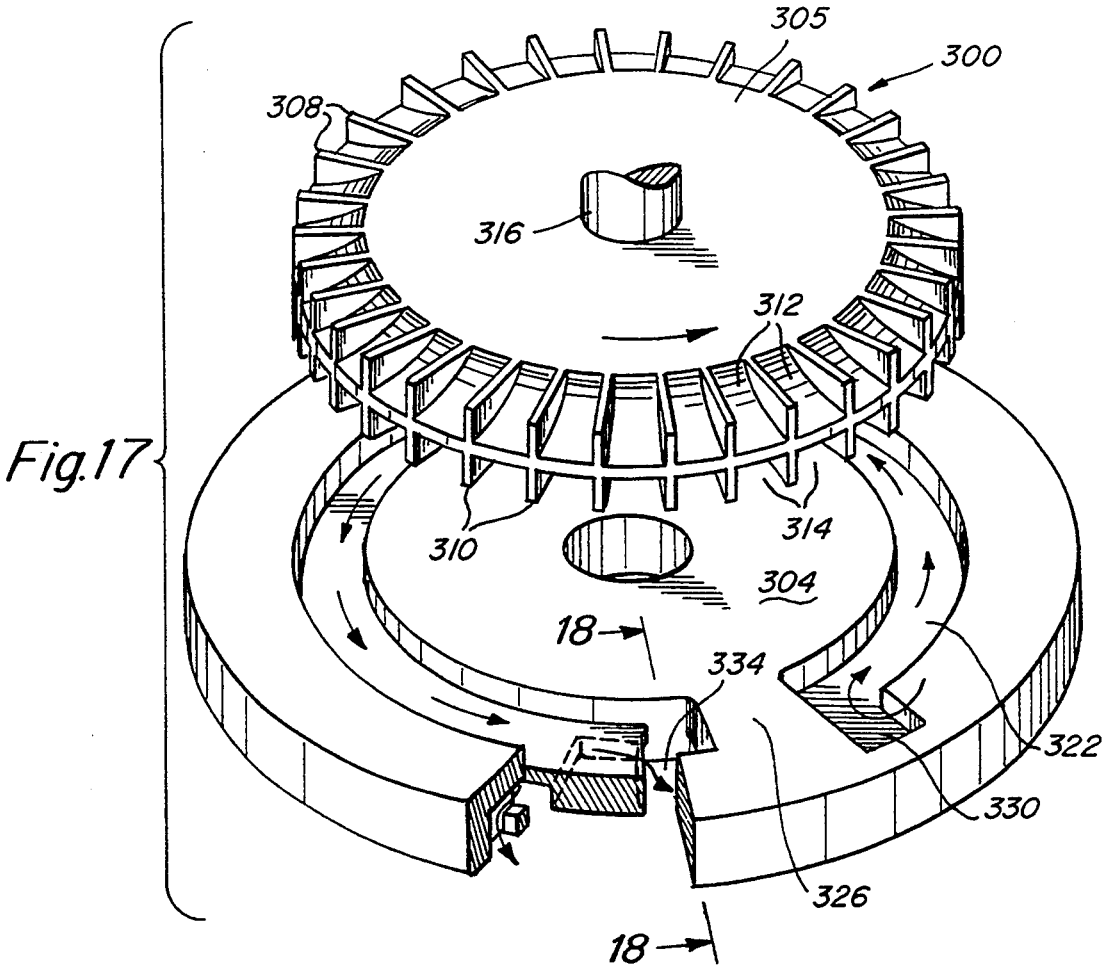
FIG. 17 is an exploded perspective view of a regenerative vacuum pumping stage showing a regenerative impeller and a lower stator portion in accordance with a fourth aspect of the invention.
Figure 18:
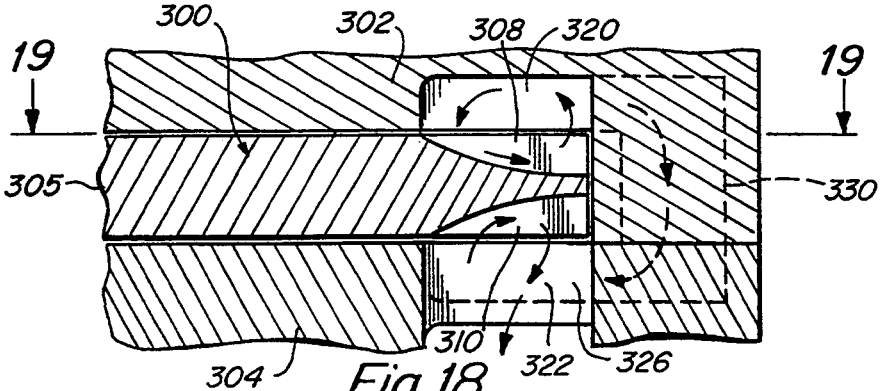
FIG. 18 is a partial cross-sectional view of the vacuum pumping stage of FIG. 17.
Figure 19:
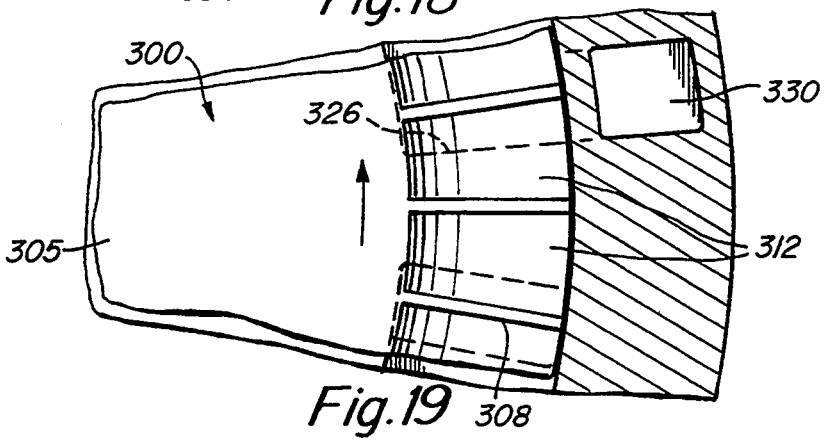
FIG. 19 is a partial cross-sectional plan view of the vacuum pumping stage taken along the line 19—19 of FIG. 18.

A fourth aspect of the present invention is shown in FIGS. 17–19. One or more axial flow vacuum pumping stages of a conventional turbomolecular vacuum pump are replaced with regenerative vacuum pumping stages. A regenerative vacuum pumping stage includes a regenerative impeller 300 which operates with a stator having an upper stator portion 302 adjacent to an upper surface of the regenerative impeller 300, and a lower stator portion 304 adjacent to the lower surface of the regenerative impeller 300. The upper stator portion 302 is omitted from FIG. 17 for clarity. The regenerative impeller 300 comprises a disk 305 having spaced-apart radial ribs 308 on its upper surface and spaced-apart radial ribs 310 on its lower surface. The ribs 308 and 310 are preferably located at or near the outer periphery of disk 305. Cavities 312 are defined between each pair of ribs 308, and cavities 314 are defined between each pair of ribs 310. In the embodiment shown in FIGS. 17–19, the cavities 312 and 314 have curved contours formed by removing material of the disk 305 between ribs 308 and between ribs 310. The cross-sectional shape of the cavities 312 and 314 can be rectangular, triangular, or any other suitable shape. The disk 305 is attached to a shaft 316 for high speed rotation around a central axis.

The upper stator portion 302 has a circular upper channel 320 formed in opposed relationship to ribs 310 and cavities 312. The lower stator portion 304 has a circular lower channel 322 formed in opposed relationship to ribs 312 and cavities 314. The upper stator portion 302 further includes a blockage (not shown) of channel 320 in one circumferential location. The lower stator portion in 304 includes a blockage 326 of channel 322 at one circumferential location. The stator portions 302 and 304 define a conduit 330 adjacent to blockage 326 that interconnects upper channel 320 and lower channel 322 around the edge of disk 305. Upper channel 320 receives gas from a previous stage through a conduit (not shown). The lower channel 322 discharges gas to a next stage through a conduit 334.

Figure 21:
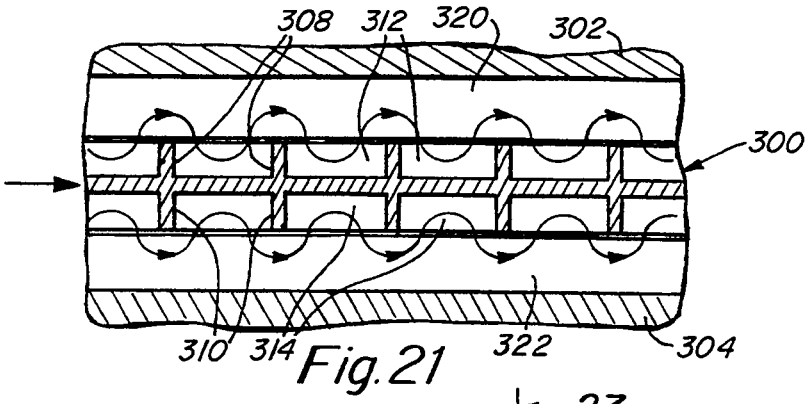
FIG. 21 is a partial cross-sectional elevation view of the regenerative vacuum pumping stage taken along the line 21—21 of FIG. 20 and showing gas flow through the upper and lower pumping channels.

In operation, disk 305 is rotated at high speed about shaft 316. Gas entering upper channel 320 from the previous stage is pumped through upper channel 320. The rotation of disk 305 and ribs 308 causes the gas to be pumped along a roughly helical path through cavities 312 and upper channel 320, as best shown in FIGS. 18 and 21. The gas then passes through conduit 330 into lower channel 322 and is pumped through channel 322 by the rotation of disk 305 and ribs 312. In the same manner, the ribs 312 cause the gas to be pumped in a roughly helical path through cavities 314 and lower channel 322. The gas is then discharged to the next stage through conduit 334.

It will be understood that the shape, size and spacing of ribs 308 and 310 and the size and shape of the corresponding cavities 312 and 314 can be varied within the scope of the present invention. The principal requirement is for a regenerative impeller having ribs on its upper and lower surfaces, and corresponding pumping channels in the stator which are connected so that gas is pumped in series through the upper stator channel and the lower stator channel to provide a high compression ratio.

Figure 20:
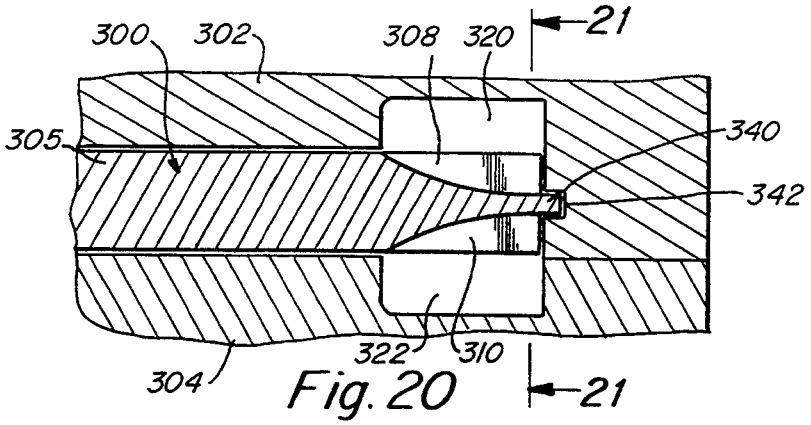
FIG. 20 is a partial cross-sectional view of another embodiment of the vacuum pumping stage of FIG. 17.

Another feature of the regenerative vacuum pumping stage is illustrated in FIG. 20. Like elements in FIGS. 18 and 20 have the same reference numerals. The disk 305 is preferably provided with an extended lip 340 at its outer periphery. The lip 340 extends radially outwardly from ribs 310 and 312 into a groove 342 in stator portions 302 and 304. As in the case of the molecular drag stages described above, the lip 340 and the groove 342 limit leakage between upper channel 320 and lower channel 322 by providing a relatively long leakage path between these channels. As in the case of the molecular drag stage, it is desirable to position ribs 308 and 310 and corresponding channels 320 and 322 as near as possible to the outer periphery of disk 300, while minimizing leakage between upper channel 320 and lower channel 322.

Figure 22:
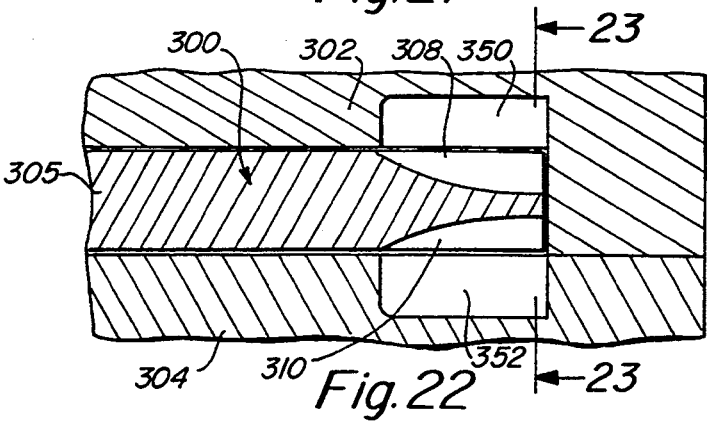
FIG. 22 is a partial cross-sectional view of another embodiment of the vacuum pumping stage of FIG. 17 wherein the stator channels are provided with ribs.
Figure 23:
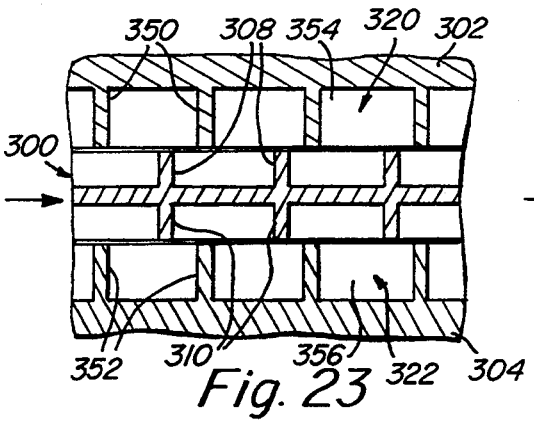
FIG. 23 is a partial cross-sectional elevation view of the vacuum pumping stage taken along the line 23—23 of FIG. 22.

Another embodiment of the regenerative vacuum, pumping stage of FIGS. 17–19 is shown in FIGS. 22 and 23. Like elements in FIGS. 17–19, 22 and 23 have the same reference numerals. The regenerative impeller 300 shown in FIG. 22 has the same construction as shown in FIG. 17, including disk 305 with ribs 308 and 310. The upper channel 320 in stator portion 302 is provided with fixed, spaced-apart radial stator ribs 350. Similarly, the lower channel 322 in stator portion 304 is provided with fixed, spaced-apart radial stator ribs 352. Cavities 354 are defined between ribs 350, and cavities 356 are defined between ribs 352. The stator ribs 350 and 352 reduce reverse flow through channels 320 and 322, respectively.

Figure 24:
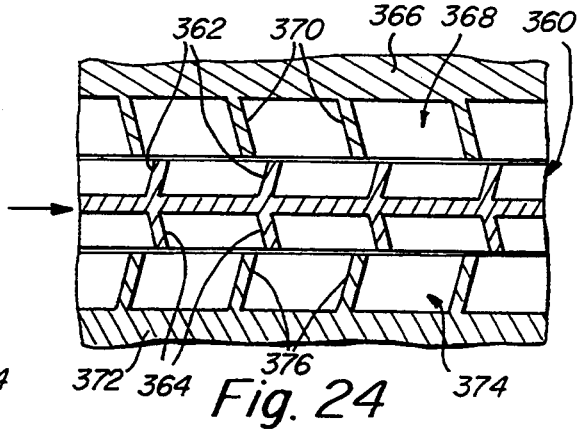
FIG. 24 is an alternate embodiment of the vacuum pumping stage of FIGS. 22 and 23 wherein the rotor and stator ribs are inclined.

Another embodiment of the regenerative vacuum pumping stage of FIGS. 22 and 23 is shown in FIG. 24. A regenerative impeller disk 360 is provided with ribs 362 on an upper surface near the outer periphery thereof and ribs 364 on a lower surface near the outer periphery thereof. The ribs 362 and 364 are inclined with respect to radial planes. An upper stator portion 366 defines an upper channel 368 in opposed relationship to ribs 362. Fixed, spaced-apart ribs 370 are located in upper channel 368. A lower stator portion 372 defines a lower channel 374 in opposed relationship to ribs 364. Fixed, spaced-apart ribs 376 are located in lower channel 374. The ribs 370 and 376 are inclined with respect to radial planes. Ribs 370 are inclined in an opposite direction with respect to ribs 362. Ribs 376 are inclined in an opposite direction with respect to ribs 364. The configuration of ribs shown in FIG. 24 provides the advantages described above. The stator ribs shown in FIGS. 22 to 24 can be used in a configuration wherein the upper and lower channels are connected in series. Alternatively, the stator ribs can be utilized in a configuration wherein the upper and lower channels are connected in parallel.

Figure 25:
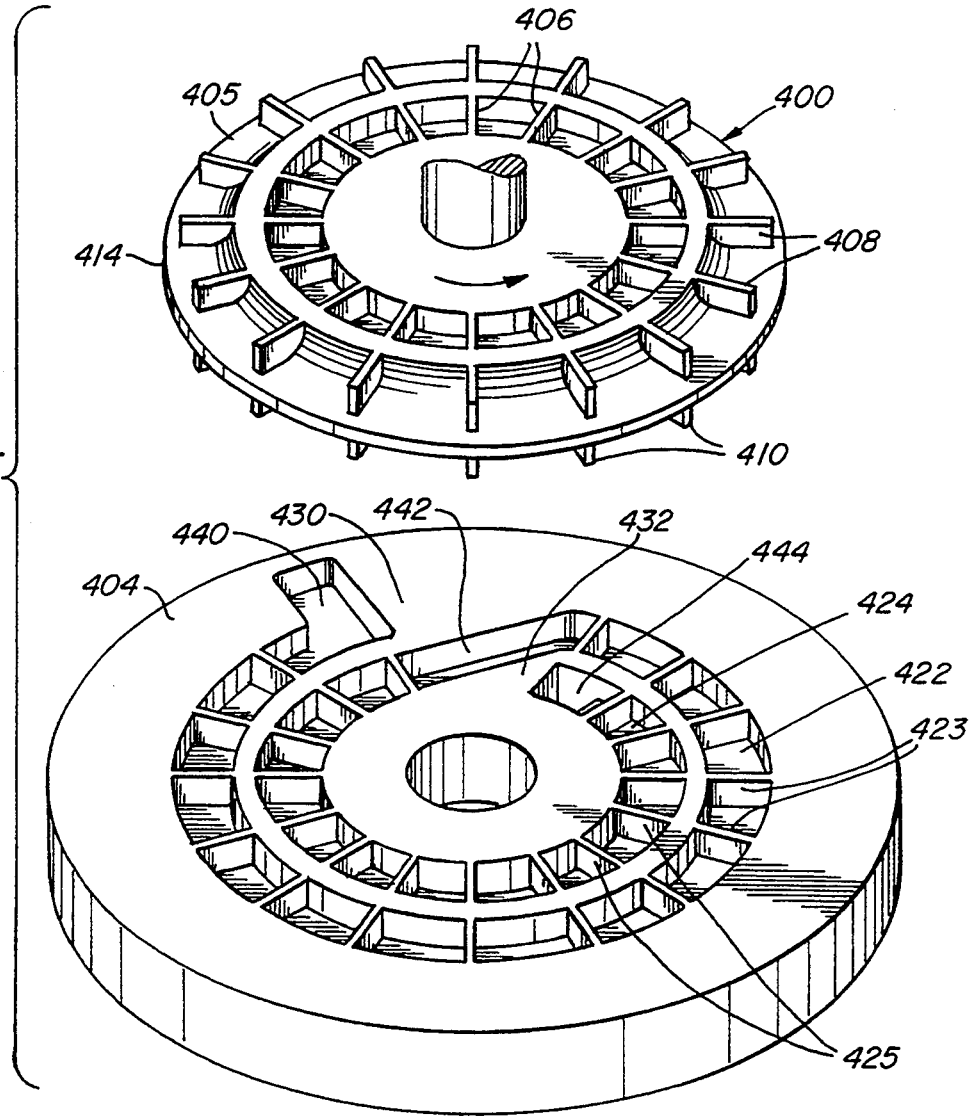
FIG. 25 is an exploded perspective view of a regenerative vacuum pumping stage, showing a regenerative impeller and a lower stator portion in accordance with another embodiment of the invention.
Figure 26:
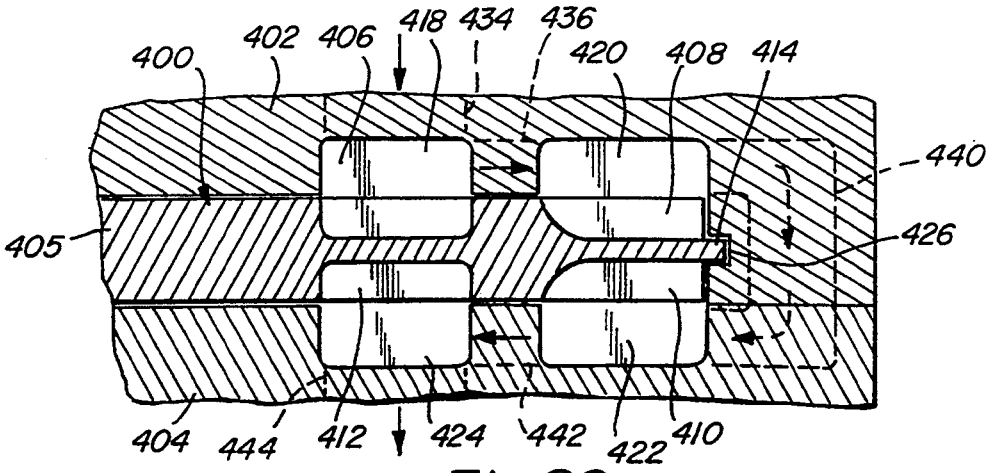
FIG. 26 is a partial cross-sectional view of the regenerative vacuum pumping stage of FIG. 25.

Another embodiment of the regenerative vacuum pumping stage in accordance with the present invention is shown in FIGS. 25 and 26. The regenerative stage includes a regenerative impeller 400, an upper stator portion 402 adjacent to an upper surface of impeller 400 and a lower stator portion 404 adjacent to a lower surface of impeller 400. The regenerative impeller 400 includes a disk 405 having spaced-apart radial ribs 408 in a circular pattern at or near the outer periphery of disk 405 and spaced-apart radial ribs 406 in a circular pattern spaced inwardly from ribs 408. Similarly, the lower surface of disk 405 is provided with spaced-apart radial ribs 410 at or near the outer periphery of disk 405 and spaced-apart radial ribs 412 in a circular pattern spaced inwardly from ribs 410. The disk 405 is provided with an outer peripheral lip 414 to reduce leakage between the upper and lower surfaces of disk 405.

The upper stator portion 402 defines a circular pumping channel 418 in opposed relationship to ribs 406 and a circular pumping channel 420 in opposed relationship to ribs 408. The lower stator portion 404 defines a circular pumping channel 422 in opposed relationship to ribs 410 and a circular pumping channel 424 and opposed relationship to ribs 412. The upper stator portion 402 includes blockages (not shown) in channels 418 and 420, respectively. Similarly, lower stator portion 404 pumped through circular channel 422, it passes through conduit 442 and is pumped through circular channel 424. Finally, the gas is exhausted through conduit 444 to the next stage. The regenerative vacuum pumping stage shown in FIG. 26 provides serial vacuum pumping through four pumping channels in series. Each channel has a regenerative configuration using a single regenerative impeller 400. As a result, the regenerative stage of FIG. 26 provides a high compression ratio.

The ribs in the rotor and the stator of the regenerative stage of FIGS. 25 and 26 can be varied as to size (height) and shape within the scope of the present invention. It will be understood that a different number of pumping channels can be utilized. For example, one of the pumping channels shown in FIGS. 25 and 26 can be omitted to provide a three channel regenerative stage, or more than four pumping channels can be utilized. The principal requirement is that the pumping channels be connected in series for a relatively high compression ratio.

Figure 27:
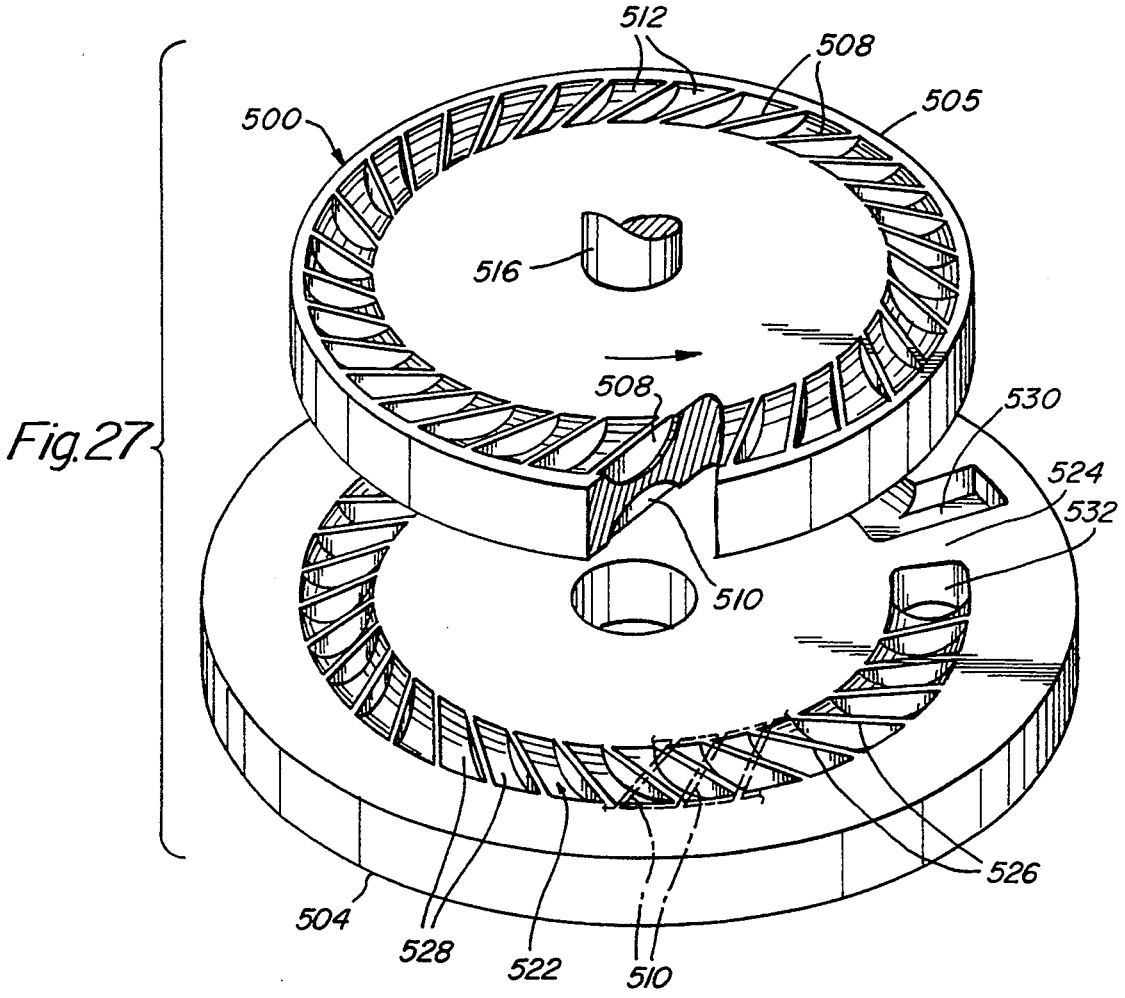
FIG. 27 is an exploded perspective view of a regenerative vacuum pumping stage wherein the rotor and stator ribs are inclined with respect to the direction of rotor motion to reduce noise during operation.

Another embodiment of the regenerative vacuum pumping stage in accordance with the present invention is shown in FIG. 27. The embodiment of FIG. 27 is similar to the embodiment of FIGS. 22 and 23, except that the rotor ribs and the stator ribs are inclined with respect to the direction of rotor rotation for smoother pumping action and to reduce includes blockages 430 and 432 in pumping channels 422 and 424, respectively. The pumping channel 422 is provided with spaced-apart, radial stator ribs 423, and the pumping channel 424 is provided with spaced-apart, radial stator ribs 425. The pumping channels 418 and 420 in upper stator portion 402 have similar spaced-apart, radial stator ribs. The stator ribs in the pumping channels reduce reverse leakage. The outer peripheral lip 414 of disk 405 extends into a circular groove 426 in upper stator portion 402 to reduce leakage between the upper and lower surfaces of disk 405.

A conduit 434 through upper stator portion 402 provides inlet to channel 418 from a previous stage. A conduit 436 through upper stator portion 402 interconnects channels 418 and 420. A conduit 440 through stator portions 402 and 404 interconnects channels 420 and 422 around the outer peripheral edge of disk 405. A conduit 442 through lower stator portion 404 interconnects channels 422 and 424. A conduit 444 through lower stator portion 404 interconnects the regenerative stage to the next vacuum pumping stage or to the exhaust port of the vacuum pump.

In operation, gas enters the regenerative vacuum pumping stage through conduit 434 from the previous stage and is pumped through circular channel 418 to conduit 436. The gas is then pumped through circular channel 420 and conduit 440 to channel 422 on the lower surface of disk 405. After the gas is noise. A regenerative impeller 500 operates with a rotor including an upper stator portion (not shown) adjacent to an upper surface of the regenerative impeller 500 and a lower stator portion 504 adjacent to a lower surface of the regenerative impeller 500. The upper stator portion is omitted from FIG. 27 for clarity. The regenerative impeller 500 comprises a disk 505 having spaced-apart rotor ribs 508 on its upper surface, and spaced-apart rotor ribs 510 (shown in phantom in FIG. 27) on its lower surface. The rotor ribs 508 and 510 are preferably located at or near the outer periphery of disk 505. Cavities 512 are defined between each pair of rotor ribs 508, and cavities (not shown) are defined between each pair of rotor ribs 510. The cavities between ribs 508 and 510 can have any suitable shape. The disk 505 is attached to a shaft 516 for high speed rotation around a central axis.

The lower stator portion 504 has a circular lower channel 522 formed in opposed relationship to ribs 510 and the corresponding cavities between ribs 510. The lower stator portion 504 further includes a blockage 524 of channel 522 at one circumferential location. The lower channel 522 is provided with spaced-apart stator ribs 526 which define cavities 528 between them. The upper stator portion has a construction similar to that of lower stator portion 504. A conduit 530 adjacent to blockage 524 interconnects the channel in the upper stator portion and lower channel 522 around the edge of disk 505. The lower channel 522 discharges gas to a next stage through a conduit 532.

The rotor ribs 508 and 510 are inclined with respect to the direction of rotation of disk 505. Similarly, the stator ribs 526 in lower channel 522 and the stator ribs in the channel of the upper stator portion are inclined with respect to the direction of rotation of disk 505. However, the ribs in the stator are inclined in the opposite direction with respect to the ribs in the rotor so that the opposed rotor and stator ribs intersect to form X's as shown in FIG. 27. The inclined ribs in the rotor and stator channels reduce a momentary interruption of pumping (when the ribs are aligned) and the generation of noise during operation. The embodiment of FIG. 27 otherwise operates in a manner similar to the regenerative vacuum pumping stages shown and described above.

Figure 28:
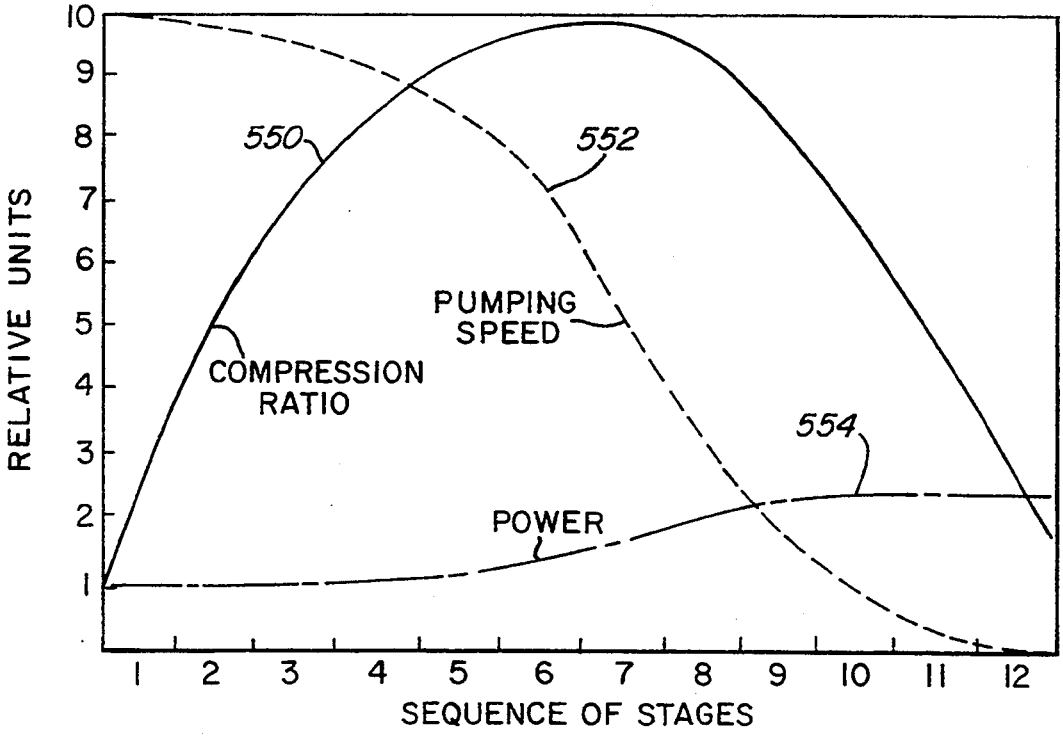
FIG. 28 is a graph showing compression ratio, pumping speed and input power of the turbomolecular vacuum pump of the present invention for each vacuum pumping stage.
Figure 29:
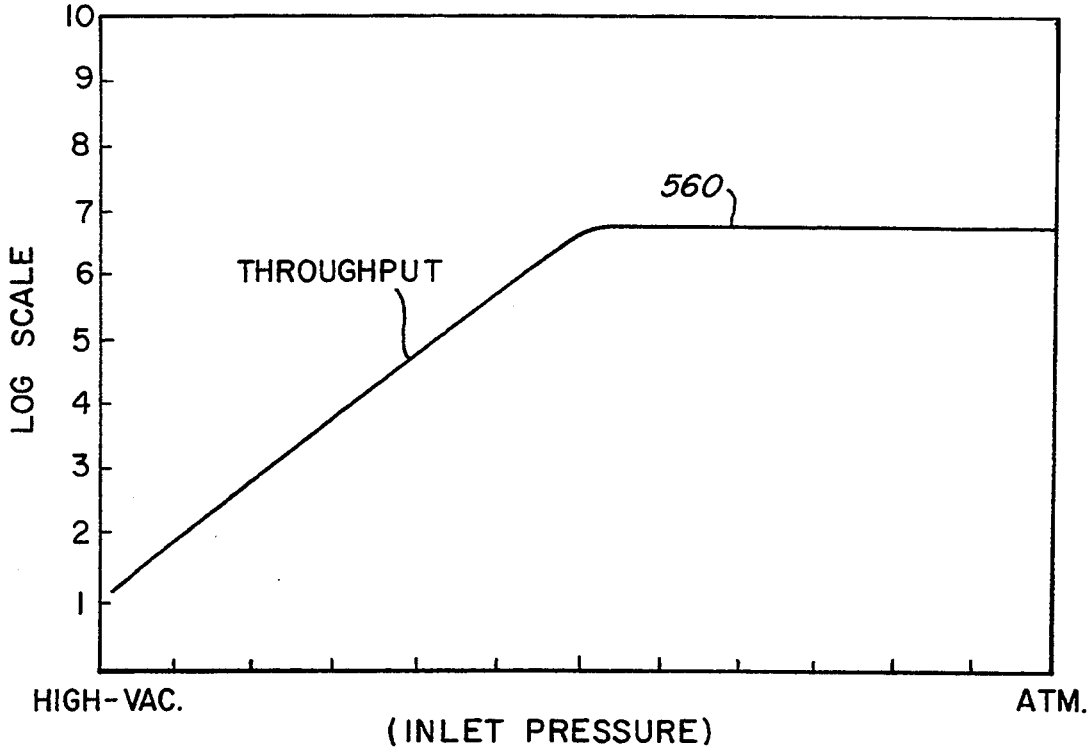
FIG. 29 is a graph of throughput of the turbomolecular vacuum pump of the present invention as a function of inlet pressure.

The operating characteristics of turbomolecular vacuum pumps in accordance with the present invention are illustrated in FIGS. 28 and 29. In FIG. 28, the pumping speed, compression ratio and input power of each stage in a multistage pump are plotted. The different stages of the pump are plotted on the horizontal axis, with high vacuum stages at the left and low vacuum stages at the right. Curve 550 represents the compression ratio and indicates that a low compression ratio is desired near the inlet port of the pump. The compression ratio reaches a maximum near the middle of the pump and decreases near the exhaust port. In general, a high compression ratio is easy to achieve in molecular flow but is difficult to achieve in viscous flow. Near the pump inlet port, the compression ratio is intentionally made low in order to obtain high pumping speed. After the gas being pumped has been densified, a higher compression ratio and a lower pumping speed are desired. The pumping speed is indicated by curve 552. A relatively high compression ratio is obtained at the higher pressures near the pump outlet by minimizing leakage, using the techniques described above, and by increasing the pump power. High pumping speed is not required near the exhaust port because the gas is densified in this region. The pump input power is indicated by curve 554. At low pressures, required power is required mainly to overcome bearing friction. At higher pressure levels, gas friction and compression power add to the power consumed by the pump. In general, the operating point of each stage is individually selected in accordance with the present invention.

In FIG. 29, the throughput of the turbomolecular vacuum pump is plotted as a function of inlet pressure. The throughput is indicated by curve 560. The point at which the throughput becomes constant is selected as a function of maximum design mass flow and maximum design power.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A turbomolecular vacuum pump comprising:

a housing having an inlet port and an exhaust port;

a plurality of axial flow vacuum pumping stages located within said housing and disposed between said inlet port and said exhaust port, each of said vacuum pumping stages including a rotor and a stator, each said rotor having a substantially constant number of inclined blades and each said stator having a number of spaced-apart openings which number diminishes in relation to the displacement of said stator from said exhaust port, wherein said number of inclined blades of each said rotor equals or exceeds said number of opening of each said stator.

2. The turbomolecular vacuum pump as defined in claim 1, wherein at least one stator having said number of openings equal to said number of inclined blades of said rotor is located in proximity to said inlet port.

3. The turbomolecular vacuum pump as defined in claim 2 wherein each of said low conductance stators comprises a circular plate having spaced-apart openings near its periphery.

4. The turbomolecular vacuum pump as defined in claim 3, wherein at least one stator which is located in proximity to said exhaust port comprises at least one louver placed near the periphery of said circular plate.

5. The turbomolecular vacuum pump as defined in claim 1 wherein said openings are defined by peripheral walls, said walls inclined with respect to said axial flow.

6. A turbomolecular vacuum pump comprising:

a housing having an inlet port and exhaust port;

a plurality of axial flow vacuum pumping stages located within said housing and disposed between said inlet port and said exhaust port, each of said vacuum pumping stages including a rotor and a stator, each said rotor having inclined blades and having a constant radial dimension for each of said vacuum pumping stages, each said stator having a conductance which varies from one stage to the other, wherein at least one stator having relatively low conductance comprises a circular plate with a central opening and at least one louver placed near the periphery of said plate and is located in proximity to a relatively high conductance stator, the highest conductance stator is located in proximity to said inlet port and one or more relatively low conductance stators are located in proximity to said exhaust port; and means for rotating said rotoring said rotors such that gas is pumped from said inlet port to said exhaust port.

7. In a turbomolecular vacuum pump comprising a housing having an inlet and exhaust port, a plurality of vacuum pumping stages within said housing and disposed between the inlet port and the exhaust port, each of said vacuum pumping stages including a rotor with a number of inclined blades and stator with a number of apertures, and means for rotating said rotor about an axis such that gas is pumped from said inlet port to said exhaust port, a method for vacuum pumping comprising the steps of:

increasing the axial bulk velocity of said pumped gas by providing at least one vacuum pumping stage in proximity to the exhaust port having stators with lower conductance than the stators of the pumping stages in proximity to the inlet port, wherein said stators with lower conductance have decreased number of apertures than said stators with higher conductance, while said number of inclined blades of said rotors are constant for each said vacuum pumping stage;

maintaining a substantially constant tangential velocity component of gas flow by providing said rotors with constant radial dimension with respect to said axis.

* * * * *